US007161454B2

(12) United States Patent
LaBoube et al.

(10) Patent No.: US 7,161,454 B2
(45) Date of Patent: Jan. 9, 2007

(54) APPARATUS AND METHOD FOR COOLING ELECTRICAL TRANSFORMERS

(75) Inventors: Timothy LaBoube, Decatur, IN (US); Roger Peniche, Fort Wayne, IN (US); Carl Maucione, Churubusco, IN (US); Michael Allen, Auburntown, TN (US); Kevin Osbun, Fort Wayne, IN (US)

(73) Assignee: General Electric Company, Schenectady, NY (US)

( * ) Notice: Subject to any disclaimer, the term of this patent is extended or adjusted under 35 U.S.C. 154(b) by 364 days.

(21) Appl. No.: 10/645,406

(22) Filed: Aug. 21, 2003

(65) Prior Publication Data

US 2005/0040924 A1 Feb. 24, 2005

(51) Int. Cl.
*H01F 27/08* (2006.01)

(52) U.S. Cl. ..... 336/55

(58) Field of Classification Search ..... 336/55–62
See application file for complete search history.

(56) References Cited

U.S. PATENT DOCUMENTS

| | | | | |
|---|---|---|---|---|
| 4,337,569 | A | 7/1982 | Pierce | 29/605 |
| 5,710,533 | A * | 1/1998 | Pla et al. | 336/100 |
| 6,157,282 | A | 12/2000 | Hopkinson | 336/57 |
| 6,399,876 | B1 | 6/2002 | Oakes | 174/15.1 |
| 6,909,349 | B1 * | 6/2005 | Longardner et al. | 336/60 |

FOREIGN PATENT DOCUMENTS

| | | |
|---|---|---|
| JP | 57-155623 | * 9/1982 |
| JP | 58-194314 | * 11/1983 |
| JP | 10-243507 | * 9/1998 |

* cited by examiner

*Primary Examiner*—Tuyen T Nguyen
(74) *Attorney, Agent, or Firm*—Cantor Colburn LLP

(57) ABSTRACT

A transformer assembly includes a transformer having a winding, a thermal sensor in thermal communication with the transformer winding, and an airflow generator in signal communication with the thermal sensor and arranged for fluid communication with the transformer winding. The airflow generator is responsive to the thermal sensor to direct an airflow toward the transformer winding in response to a temperature at the winding.

28 Claims, 3 Drawing Sheets

APPARATUS AND METHOD FOR COOLING ELECTRICAL TRANSFORMERS

BACKGROUND OF THE INVENTION

The present disclosure relates generally to an apparatus and method for cooling electrical transformers, and particularly to an apparatus for controlled cooling of electrical transformers.

Electrical distribution transformers operate at a variety of kVA (kilo-Volt-Ampere) ratings, with a typical rating being 15 kVA or higher, may be dry-type or oil-filled, and may be single-phase or three-phase. Due to the electrical and magnetic characteristics of transformers, an energized transformer operating at full rated load may generate an appreciable amount of heat that needs to be dissipated. Dry-type transformers have been designed to manage this heat by sizing the electrical components for low resistance, sizing the magnetic components for low eddy current heating, and by employing a flee convection heat transfer surface to assist in heat dissipation. Oil-filled transformers have been designed to manage this heat by recirculating the oil between the coils and a heat exchanger and by employing fans or blowers to assist in cooling the oil at the heat exchanger. However, as power distribution demands increase, so does the size and cost associated with dry-type transformers, and so does the size, cost and environmental concerns associated with oil-filled transformers. Accordingly, there is a need in the art for an electrical transformer assembly that overcomes these drawbacks.

SUMMARY OF THE INVENTION

In one embodiment, a transformer assembly includes a transformer having a winding, a thermal sensor in thermal communication with the transformer winding, and an airflow generator in signal communication with the thermal sensor and arranged for fluid communication with the transformer winding. The airflow generator is responsive to the thermal sensor to direct an airflow toward the transformer winding in response to a temperature at the winding.

In another embodiment, a method of operating a transformer includes energizing the transformer, sensing the temperature of a winding of the transformer via a thermal switch, and actuating a fan in response to the sensed temperature at the thermal switch exceeding a temperature threshold.

In a further embodiment, a transformer assembly includes a three-phase dry-type transformer having at each phase: a transformer phase winding; first, second, and third thermal switches in thermal communication with the respective phase winding; and a fan in signal communication with the respective first thermal switch and arranged for fluid communication with the respective phase winding. Each phase fan is responsive to the respective first thermal switch for directing an airflow toward the respective phase winding in response to the respective phase winding temperature being in excess of a first temperature threshold. Each second thermal switch is arranged to provide a signal indicative of the respective phase winding temperature being in excess of a second temperature threshold, and each third thermal switch is arranged to provide a signal indicative of the respective phase winding temperature being in excess of a third temperature threshold. The first temperature threshold is less than the second temperature threshold, and the second temperature threshold is less than the third temperature threshold.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the present invention provides a three-phase dry-type transformer having direct forced air convective cooling controlled via thermal switches. While the embodiment described herein depicts thermal switches as an exemplary temperature control arrangement, it will be appreciated that other temperature control arrangements may be employed, such as thermocouples with programmable logic controllers for example. It will also be appreciated that the scope of the invention also encompasses single-phase dry-type transformers having a thermally controlled forced air convective cooling arrangement.

Figure 1:
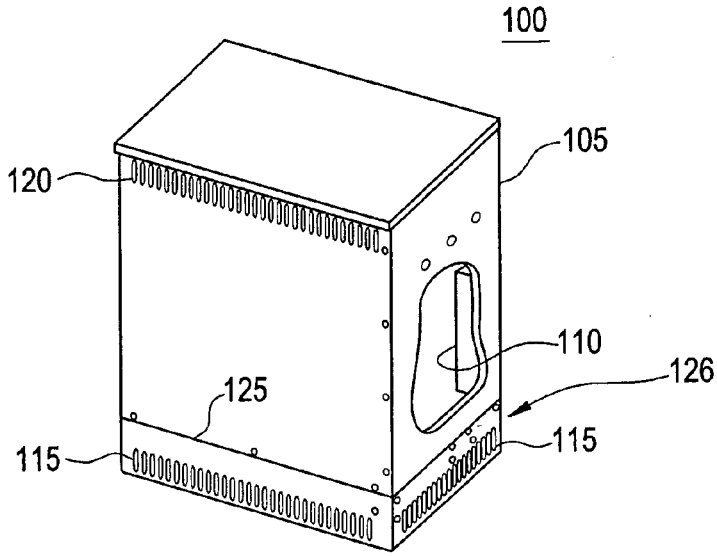
FIG. 1 depicts an isometric view of an exemplary transformer assembly in accordance with an embodiment of the invention.
Figure 2:
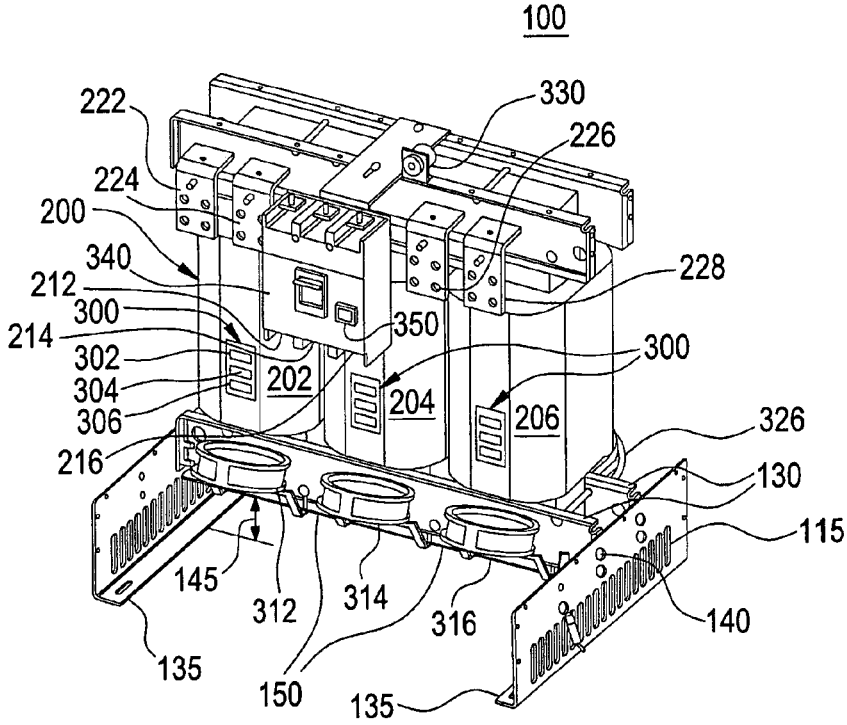
FIG. 2 depicts an isometric view of the transformer assembly of FIG. 1 with a substantial part of the housing removed.

FIG. 1 is an exemplary embodiment of a transformer assembly 100 having a portion of the housing 105 cut away to show an interior surface with insulation 110 for sound proofing. While only a small portion of insulation 110 is shown, it will be appreciated that the insulation 110 may be placed as appropriate within housing 105 to achieve the desired level of noise reduction. FIG. 2 depicts transformer assembly 100 with a substantial portion of housing 105 removed, thereby showing the interior components of transformer assembly 100.

In an embodiment and referring now to FIG. 2, transformer assembly 100 includes a three-phase dry-type transformer 200 (herein after referred to as transformer 200) having an A-phase 202, a B-phase 204, and a C-phase 206. Each phase 202, 204, 206, has primary and secondary windings, depicted generally at 202, 204, 206, respectively, primary connections 212, 214, 216, respectively, and secondary connections 222, 224, 226, respectively. A fourth connection 228 is also provided, which may be used as a neutral, mid-tap or other secondary connection. Thermally coupled to each phase 202, 204, 206, is a set 300 of first 302, second 304, and third 306 sensors, such as thermal switches for example. Each thermal switch 302, 304, 306, is arranged in thermal communication with either the primary winding or secondary winding of the respective transformer phase to sense a temperature rise condition at the respective transformer windings. Arranged proximate each transformer phase 202, 204, 206, is a fan assembly 312, 314, 316, for directing a flow of air toward the respective transformer windings on command. It will be appreciated that fan assemblies can consist of one or more fans. As depicted in FIG. 2, transformer phase 206 has a fan 316 on the front and a fan 326 on the back. Other fans are hidden from view but may be employed on the opposing side of transformer phase 202, 204, 206, thereby delivering an airflow directly to the windings at both sides of transformer 200 for effective forced air convective cooling. While reference is made herein to sensors 302, 304, 306 being thermal switches, it will be appreciated that other sensors, such as temperature sensors, humidity sensors, power ON sensors, or any other sensor capable of sensing an operating characteristic of transformer 200, may be employed. In an exemplary embodiment using power ON sensors for senor 302, for example, fan assemblies 312, 314, 316 may be turned ON when sensor 302 senses the power being ON at transformer 200, thereby providing continuous forced convective cooling at transformer 200. The control scheme for utilizing the signals from thermal switches 302, 304, 306, and for operating fan assemblies 312, 314, 316, as well as for operating other devices discussed below, will now be described with reference to FIGS. 2 and 3.

Figure 3:
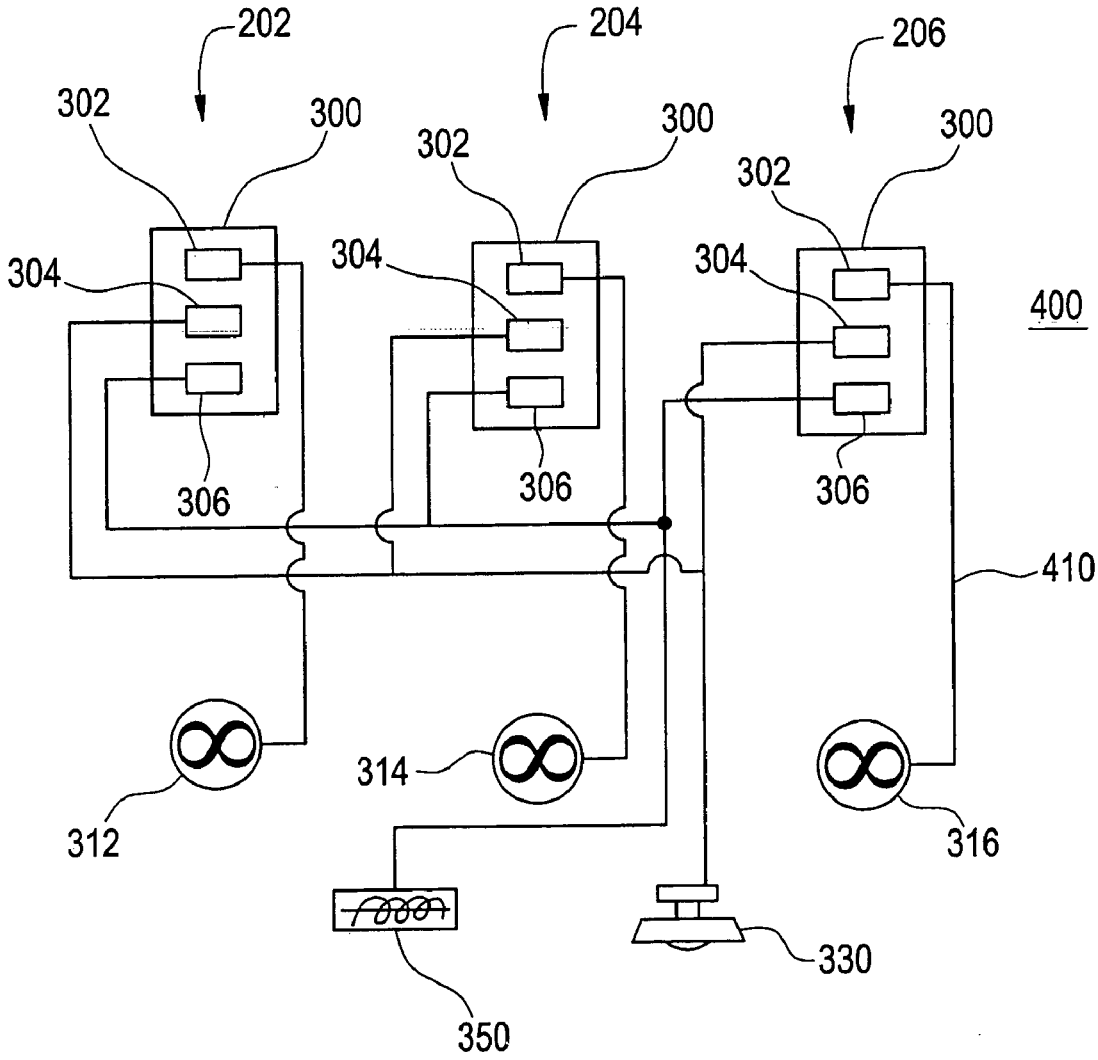
FIG. 3 depicts an exemplary one-line wiring diagram of a control scheme for use in the assembly of FIG. 2.

FIG. 3 depicts a one-line diagram 400 for the control scheme associated with thermal switches 302, 304, 306 at each phase 202, 204, 206 of transformer 200. Solid lines 410 between elements depict signal communication lines between those elements. First thermal switch 302 is disposed at each phase of transformer 200 and is in signal communication with a fan assembly 312, 314, or 316, depending on the phase. When transformer 200 is energized, each first thermal switch 302 senses the temperature at the windings of the respective transformer phase, and in response to the winding temperature exceeding a first temperature threshold, first thermal switch 302 closes, thereby turning on power to the respective cooling fan assembly 312, 314, 316. In an alternative embodiment, each first thermal switch 302 senses the rate of temperature rise at the windings of the respective transformer phase, and in response to the rate of temperature rise exceeding a defined rate, proactively turning on the respective cooling fan assembly 312, 314, 316.

Second thermal switch 304 is disposed at each phase of transformer 200. Each second thermal switch 304 is in signal communication with the same alarm device 330, which may be a buzzer or other audible device. While alarm device 330 is depicted as an audible device mounted inside housing 105, it will be appreciated that other alarm devices may be employed, such as a flashing light for example, which may be mounted outside of housing 105 for providing a visual alarm signal. Second thermal switches 304 sense the temperature at the windings of the respective transformer phase, and in response to the winding temperature exceeding a second temperature threshold, second thermal switch 304 closes, thereby turning on power to activate alarm device 330. In an embodiment, the second temperature threshold is greater than the first temperature threshold, but is less than the insulation degradation temperature rating of the transformer windings. The insulation degradation temperature rating is different from the insulation temperature rating in that the former takes into account the amount of time that an elevated temperature needs to be present before the insulation material experiences degradation in its electrical properties.

Third thermal switch 306 is disposed at each phase of transformer 200. Each third thermal switch 306 is in signal communication with the same electrical disconnect device 340 via a shunt trip 350 or other suitable tripping device. Electrical disconnect device 340 is electrically connected in series with transformer 200 on either the primary or secondary side, and may be a switch, a circuit breaker, or any other suitable electrical disconnect. Shunt trip 350 is a tripping device suitable for receiving an electrical signal and for delivering a mechanical trip signal in response thereto, thereby resulting in electrical disconnect device 340 disconnecting power at transformer 200 on command. Third thermal switches 306 sense the temperature at the windings of the respective transformer phase, and in response to the winding temperature exceeding a third temperature threshold, third thermal switch 306 closes, thereby turning on power to activate shunt trip 350 and to trip, or open, electrical disconnect device 340. In an embodiment, the third temperature threshold is greater than the second temperature threshold, but is less than the insulation degradation temperature rating of the transformer windings.

First, second, and third thermal switches 302, 304, 306 return to an open condition in response to the temperature at the windings of transformer 200 falling below the first, second, and third temperature thresholds, plus or minus control ranges, respectively. Power to operate fan assemblies 312, 314, 316, alarm device 330, and shunt trip 350, may be derived from transformer 200.

In an alternative embodiment, alarm device 330 and electrical disconnect device 340 may not be present, and second and third thermal switches 304, 306 may be in signal communication only with a wiring harness, which may be subsequently accessed by a user for connecting an aftermarket alarm device 330 or electrical disconnect device 340.

Figure 4:
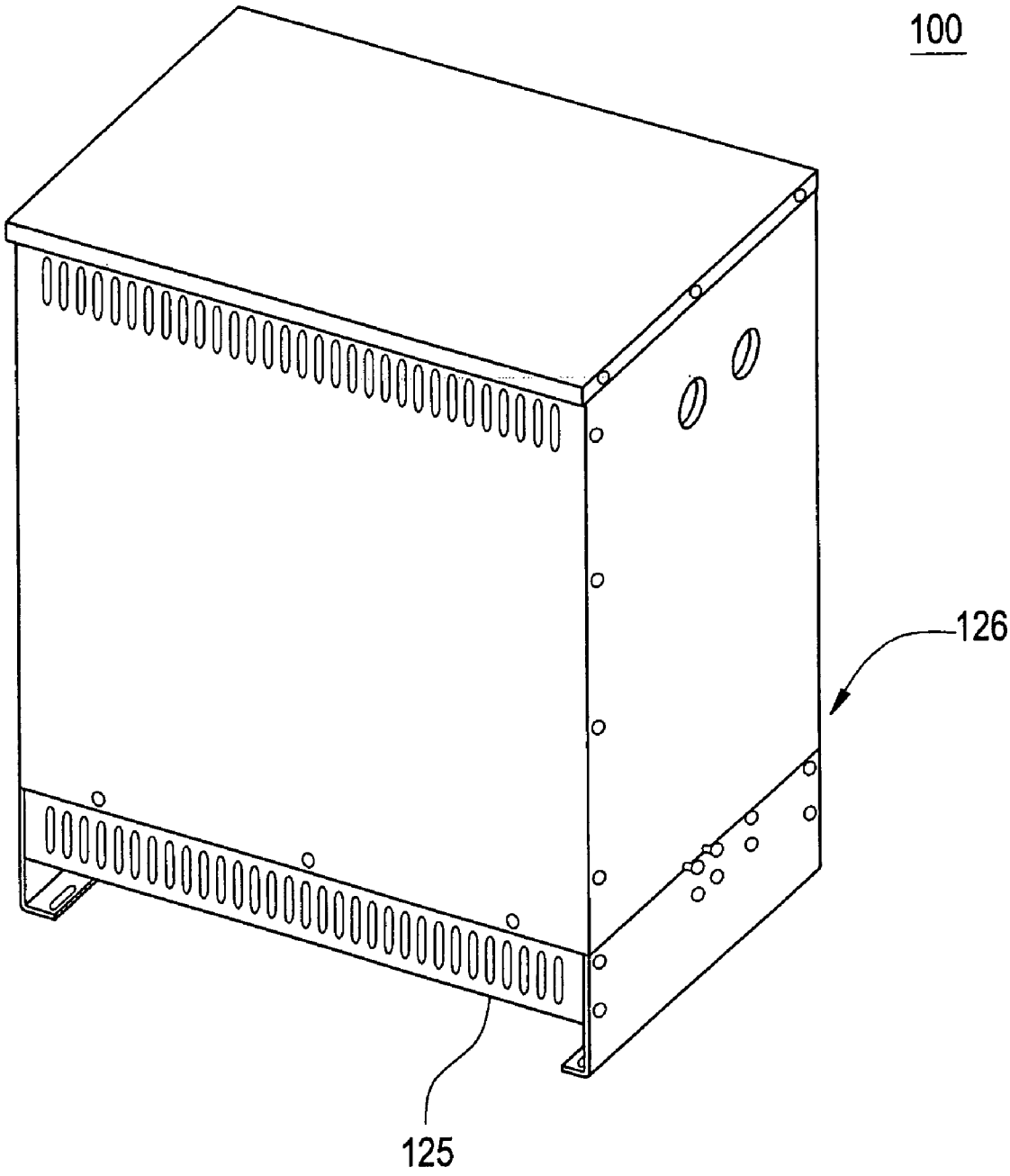
FIG. 4 depicts an isometric view of the exemplary transformer of FIG. 1 having a displaced panel in accordance with an embodiment of the invention.

Referring now to FIGS. 1 and 2, housing 105 includes bottom vents 115 for permitting air passage into housing 105 of transformer assembly 100, and top vents 120 for permitting air passage out of housing 105 of transformer assembly 100. Housing 105 also includes a movable front grill panel 125 and a similarly configured back grill panel 126, which is hidden from view, that may be lifted up, pivoted up, or removed altogether. FIG. 1 shows movable front grill panel 125 in place, while FIG. 2 shows both 125 and 126 removed. A support member 130 for supporting transformer 200 and other attached structural elements is attached to side panels 135 via suitable hardware 140 in such a manner as to provide a vertical clearance 145 between the underside of support member 130 and the ground on which side grill panels 135 sit. At the underside of support member 130 are lifting surfaces 150, which are suitable for receiving a lifting device, such as a fork on a fork lift truck for example. With front grill panel 125, back grill panel 126, or both, removed, and with the ground clearance provided by vertical clearance 145, transformer assembly 100 may be readily lifted at lifting surfaces 150 and maneuvered into place. In an alternative embodiment, front grill panel 125 and back grill panel 126 are strong enough to serve themselves as lifting structures. Accordingly, transformer assembly 100 may be readily lifted at 125 and 126 when they are attached to housing 105 and placed in the lifted position as shown in FIG. 4. Clearance 145 also allows for ease of maintenance for fan assemblies 312, 314, 316.

In an embodiment and to facilitate wiring connections within transformer assembly 100, primary connections 212, 214, 216 are disposed on the same side of three-phase transformer 200 as are secondary connections 222, 224, 226 and 228, thereby enabling electrical disconnect device 340 to be disposed on the same side of transformer 200 as well. By sideways centrally locating primary connections 212, 214, 216, and sideways peripherally locating secondary connections 222 and 224 to one side, and secondary connections 226 and 228 to the other side of transformer 200, electrical disconnect device 340 may be sideways centrally located within housing 105, thereby providing appreciable wire bending space for the heavy power cables (not shown). The user primary connections 212, 214, 216 of transformer 200, located at the bottom of electrical disconnect device 340 provide better bottom access and less wire bending than would be required with a forward fed arrangement. Having all wiring connections accessible from one side of transformer 200 provides the customer with ease of installation.

Some embodiments of the invention have some of the following advantages: low operational noise as a result of sound insulation; thermally activated direct forced air convective cooling; thermally activated alarm prior to insulation degradation resulting from an overtemperature condition; thermally activated disconnect prior to insulation degradation resulting from an overtemperature condition; enhanced system reliability and safety from independently operated thermal switches; increased efficiency since it uses a smaller core, hence has lower losses; ease of maneuverability; readily accessible wire connections; reduced size, weight, and cost; and, enhanced ability to locate the transformer in local regions, as a result of active cooling.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A transformer assembly, comprising:

a transformer;

a thermal sensing and control device in thermal communication with the transformer;

a cooling device in signal communication with the thermal sensing and control device, and arranged for cooling the transformer on command; and an electrical disconnect device in signal communication with the thermal sensing and control device, and arranged for disconnecting the transformer from a source of electrical power on command;

wherein the cooling device is responsive to a first signal from the thermal sensing and control device, and the electrical disconnect is responsive to a second signal from the thermal sensing and control device.

2. The assembly of claim 1, wherein:

the transformer comprises a primary winding with a primary connection and a secondary winding with a secondary connection;

the thermal sensing and control device comprises a first thermal sensor in thermal communication with the primary winding, the secondary winding, or combination thereof; and the cooling device comprises an airflow generator in signal communication with the first thermal sensor and arranged for fluid communication with the primary winding, the secondary winding, or combination thereof;

wherein the airflow generator is responsive to the first thermal sensor to direct an airflow toward the primary winding, secondary winding, or combination thereof, in response to a winding temperature being in excess of a first temperature threshold.

3. The assembly of claim 2, wherein the transformer is a dry-type transformer.

4. The assembly of claim 2, wherein:

the thermal sensing and control device further comprises a second thermal sensor in thermal communication with the primary winding, the secondary winding, or combination thereof; and further comprising;

an alarm device in signal communication with the second thermal sensor;

wherein the alarm device is responsive to the second thermal sensor to signal an alarm condition in response to a winding temperature being in excess of a second temperature threshold.

5. The assembly of claim 4, wherein:

the thermal sensing and control device further comprises a third thermal sensor in thermal communication with the primary winding, the secondary winding, or combination thereof; and the electrical disconnect device is in signal communication with the third thermal sensor and is in electrical communication with the transformer;

wherein the electrical disconnect device is responsive to the third thermal sensor to disconnect electrical power at the transformer in response to a winding temperature being in excess of a third temperature threshold.

6. The assembly of claim 5, wherein the fast, second and third thermal sensors are thermal switches.

7. The assembly of claim 5, wherein the fast temperature threshold is less than the second temperature threshold, and the second temperature threshold is less than the third temperature threshold.

8. The assembly of claim 7, wherein the first, second, and third temperature thresholds are less than the insulation degradation temperature rating of the transformer windings.

9. The assembly of claim 5, wherein the electrical disconnect device is a switch or a circuit breaker.

10. The assembly of claim 2, further comprising:

a support member having a lifting surface arranged for lifting the assembly; and a housing having a first vent for permitting air passage into the housing and a second vent for permitting air passage cut of the housing.

11. The assembly of claim 5, wherein the transformer is a three-phase transformer.

12. The assembly of claim 11, wherein the electrical disconnect device is disposed proximate the central transformer of the three-phase transformer, and the user primary connections of the electrical disconnect device are disposed at the bottom of the electrical disconnect device.

13. The assembly of claim 12, wherein the electrical disconnect device is disposed on the same side of the transformer as are the secondary connections of the transformer.

14. The assembly of claim 2, wherein the airflow generator comprises a first fan arranged for directing a first airflow at a first side of the transformer and a second fan arranged for directing a second airflow at a second opposing side of the transformer.

15. The assembly of claim 10, wherein, the housing further includes an interior surface insulated for sound.

16. A transformer assembly, comprising:

a three-phase dry-type transformer having at each phase a primary winding with a primary connection and a secondary winding with a secondary connection;

a first, second, and third thermal switch at each phase in thermal communication with the respective primary winding, secondary winding, or combination thereof; and a fan at each phase in signal communication with the respective first thermal switch, and arranged for fluid communication with the respective primary winding, secondary winding, or combination thereof;

wherein each fan is responsive to the respective first thermal switch for directing an airflow toward the respective primary winding, secondary winding, or combination thereof, in response to a respective winding temperature being in excess of a first temperature threshold;

wherein the second thermal switch at each phase is arranged to provide a signal indicative of a respective winding temperature being in excess of a second temperature threshold;

wherein the third thermal switch at each phase is arranged to provide a signal indicative of a respective winding temperature being in excess of a third temperature threshold;

wherein the first temperature threshold is less than the second temperature threshold, and the second temperature threshold is less than the third temperature threshold.

17. The assembly of claim 16, further comprising:

a support member having a lifting surface arranged for lifting to assembly; and a housing having a first vent for permitting air passage into the housing, and a second vent for permitting air passage out of the housing;

wherein the primary and secondary connection at each phase are disposed on the same side of the three-phase transformer.

18. A transformer assembly, comprising:

a transformer, a sensor in signal communication with the transformer for sensing an operating characteristic thereof;

another sensor in signal communication with the transformer, the another sensor arranged for signal communication with an electrical disconnect device; and an airflow generator in signal communication with the sensor and arranged for fluid communication with the transformer;

wherein the airflow generator is responsive to the sensor for directing an airflow toward the transformer in response to the sensed operating characteristic being desirous of an airflow at the transformer.

19. The assembly of claim 18, wherein the operating characteristic desirous of an airflow at the transformer is a temperature value, a humidity level, a power ON condition, or any combination comprising at least one of the foregoing.

20. The assembly of claim 19, wherein the sensor senses the power ON condition at the transformer and the airflow generator is responsive thereto.

21. The assembly of claim 18, further comprising:

a support member having a lifting surface arranged for lifting the assembly; and a housing having a first vent for permitting air passage into the housing and a second vent for permitting air passage out of the housing.

22. The assembly of claim 18, further comprising:

a further sensor in signal communication with the transformer, the further sensor arranged for signal communication with an alarm device;

wherein the sensor is a first sensor, the further sensor is a second sensor, and the another sensor is a third sensor;

wherein in response to the second sensor sensing a second temperature threshold at the transformer, the second sensor provides an alarm signal for the alarm device; and wherein in response to the third sensor sensing a third temperature threshold at the transformer, the third sensor provides a trip signal for the electrical disconnect device.

23. A method of operating a transformer assembly, the assembly comprising a transformer, a thermal sensing and control device in thermal communication with the transformer, a cooling device in signal communication with the thermal sensing and control device, and arranged for cooling the transformer on command, and an electrical disconnect device in signal communication with the thermal sensing and control device, and arranged for disconnecting the transformer from a source of electrical power on command, the method comprising:

receiving a first signal from the thermal sensing and control device, and operating the cooling device in response thereto; and receiving a second signal front the thermal sensing and control device, and operating the electrical disconnect device in response thereto.

24. The method of claim 23 wherein the cooling device comprises a fan, and further comprising:

energizing the transformer;

sensing the temperature of a winding of the transformer via a first thermal switch productive of the first signal; and actuating the fan in response to the sensed temperature at the first thermal switch exceeding stint temperature threshold.

25. The method of claim 24, further comprising:

sensing the temperature of a winding of the transformer via a second thermal switch; and actuating an alarm in response to the sensed temperature at the second thermal switch exceeding a second temperature threshold, the second temperature threshold being greater than the first temperature threshold.

26. The method of claim 25, further compromising:

sensing the temperature of a winding of the transformer via a third thermal switch productive of the second signal; and actuating the electrical disconnect in response to the sensed temperature at the third thermal switch exceeding a third temperature threshold, the third temperature threshold being greater than the second temperature threshold.

27. The method of claim 26, wherein:

the transformer comprises a three-phase transformer;

the sensing the temperature of a winding of the transformer visa first thermal switch comprises sensing at each phase the temperature of a winding of the transformer via a first thermal switch disposed at each phase; and the actuating a fan comprises actuating a fan disposed at a phase of the transformer in response to the sensed temperature at the first thermal switch of the respective phase exceeding the first temperature threshold, each phase of the transformer having an associated first thermal switch and fan.

28. The method of claim 27, wherein:

the sensing the temperature of a winding of the transformer via a second thermal switch comprises sensing at each phase the temperature of a winding of the transformer via a second thermal switch disposed at each phase;

the sensing the temperature of a winding of the transformer via a third thermal switch comprises sensing at each phase the temperature of a winding of the transformer via a third thermal switch disposed at each phase;

the actuating an alarm comprises actuating an alarm in response to the sensed temperature at any of the second thermal switches exceeding the second temperature threshold; and the actuating an electrical disconnect comprises actuating an electrical disconnect in response to the sensed temperature at any of the third thermal switches exceeding the third temperature threshold.

* * * * *

UNITED STATES PATENT AND TRADEMARK OFFICE

CERTIFICATE OF CORRECTION

PATENT NO. : 7,161,454 B2
APPLICATION NO. : 10/645406
DATED : January 9, 2007
INVENTOR(S) : Timothy LaBoube et al.

It is certified that error appears in the above-identified patent and that said Letters Patent is hereby corrected as shown below:

Column 1,

Line 20, after "a" delete "flee" and insert therefor -- free --.

Column 8,

Line 58, after "former" delete "visa" and insert therefor -- via --.

Signed and Sealed this

Twenty-fourth Day of April, 2007

JON W. DUDAS
*Director of the United States Patent and Trademark Office*